US006257026B1

(12) United States Patent
Ando' et al.

(10) Patent No.: US 6,257,026 B1
(45) Date of Patent: Jul. 10, 2001

(54) NEEDLE CONTROL DEVICE FOR STOCKING KNITTING MACHINES

(75) Inventors: Jan Ando'; Giuseppe Caccivio, both of Scandicci (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/575,936

(22) Filed: May 23, 2000

(30) Foreign Application Priority Data

May 24, 1999 (IT) ..... MI99A1145

(51) Int. Cl.[7] ..... D04B 9/10
(52) U.S. Cl. ..... 66/221
(58) Field of Search ..... 66/215, 216, 217, 66/218, 219, 220, 221–222, 223, 224, 225, 227

(56) References Cited

U.S. PATENT DOCUMENTS

| | | | | |
|---|---|---|---|---|
| 2,025,462 | * | 12/1935 | Lombardi . | |
| 2,025,463 | | 12/1935 | Lombardi . | |
| 3,678,710 | * | 7/1972 | Gostelow | 66/14 |
| 3,930,383 | | 1/1976 | Nuber . | |
| 3,948,062 | * | 4/1976 | Sumitomo | 66/219 |
| 5,367,893 | * | 11/1994 | Fucik | 66/222 |
| 5,375,436 | * | 12/1994 | Fucik | 66/221 |
| 5,425,252 | * | 6/1995 | Lonati | 66/219 |
| 5,775,135 | * | 7/1998 | Shibata et al. | 66/219 |
| 5,960,645 | * | 10/1999 | Sangiacomo | 66/13 |

FOREIGN PATENT DOCUMENTS

| | | | | |
|---|---|---|---|---|
| 20 08 822 | | 10/1970 | (DE) . | |
| 0 074 931 | | 3/1983 | (EP) . | |
| 2 151 972 | | 4/1973 | (FR) . | |
| 1354980 | * | 5/1974 | (GB) | 66/213 |
| 0 264 308 | | 8/1993 | (GB) . | |

* cited by examiner

*Primary Examiner*—Danny Worrell
(74) *Attorney, Agent, or Firm*—Welsh & Katz, Ltd.

(57) ABSTRACT

A needle control device for stocking knitting machines, comprising a connecting element which can engage a needle or sub-needle or slider and can be arranged in the same slot of the needle holder that accommodates a needle, and an actuation element which is connected to the connecting element and can oscillate on command on a plane which is substantially parallel to the sides of the corresponding slot of the needle holder in which it is accommodated. The actuation element is provided with at least one first heel and at least one second heel which are mutually spaced along the side of the actuation element that lies opposite the side meant to be directed toward the bottom of the slot of the needle holder. The actuation element is movable, as a consequence of its oscillation, into three positions, respectively a first position, in which the heels are both inserted in the corresponding slot of the needle holder, a second position, in which the first heel protrudes from the slot of the needle holder while the second heel is inserted in the slot of the needle bolder, and a third position, in which the first heel is inserted in the slot of the needle holder while the second heel protrudes from the slot of the needle holder.

8 Claims, 2 Drawing Sheets

NEEDLE CONTROL DEVICE FOR STOCKING KNITTING MACHINES

BACKGROUND OF THE INVENTION

The present invention relates to a needle control device for stocking knitting machines.

It is known that stocking knitting machines generally comprise a needle holder in which a plurality of slots are arranged side by side, each slot accommodating a needle which can be actuated in order to produce knitting.

The needle holder can be substantially flat, for example as in rectilinear machines, or can be cylindrical, for example as in circular machines.

In some machines, the needles are provided with a heel which protrudes from the slot of the needle holder inside which it is accommodated, so as to engage in appropriately provided paths traced by cams which face the needle holder. In practice, by actuating the needle holder with a continuous or reciprocating motion with respect to the cams or vice versa, the needles travel, with their heel, along such paths and are moved along the slots of the needle holder or maintain a stationary position inside said slots, so as to form stitches or be excluded from knitting, according to the configuration of these paths.

In double-cylinder circular stocking knitting machines, the needle is provided with a double point and has no heels. In this case, the needle is actuated by means of sliders which are accommodated inside the lower needle cylinder and inside the upper needle cylinder, each slider being accommodated in the same slot of the needle holder that accommodates a needle and being provided with a hook which can engage the lower point or the upper point of the needle in order to produce its actuation. The sliders are provided with one or more heels which protrude from the slot of the needle holder inside which they are accommodated so as to engage appropriately provided cams which trace paths for said heels, so as to produce, following the actuation of the needle holder with respect to said cams, the movement of the corresponding needle in order to form stitches. The cams further trace suitable paths for producing the transfer of the needles from the lower needle cylinder to the upper needle cylinder or vice versa.

The needles of stocking knitting machines can also be actuated by means of sub-needles or selectors, each of which is accommodated in a slot of the needle holder which accommodates a needle and faces the end of the needle that lies opposite its point, or faces the end of the slider that lies opposite its end that can engage the needle, in the case of double-cylinder circular machines.

Also these sub-needles or selectors are provided with heels which protrude from the corresponding slot of the needle holder and can engage paths traced by appropriately provided cams which face the needle holder so as to produce the movement of the sub-needle or selector along the corresponding slot of the needle holder in order to produce the actuation of the corresponding needle.

In order to allow the execution of a wide range of knitting types, many of the cams that face the needle holder and trace the paths for the heels of the selectors, of the sub-needles, of the sliders and of the needles in the various machines are provided so that they can move on command toward or away from the needle holder, so as to allow to vary on command, according to a preset knitting program, the path traced for the heels of said elements.

Other selectors are further movable from an inactive position, in which they are inserted, with at least part of their heels, in the corresponding slot of the needle holder, so as to avoid engaging the paths traced by the cams, to an active position, in which they are extracted, with said heels, from the corresponding slot of the needle holder, so as to engage these paths.

The selectors are transferred to the active position or to the inactive position by means of appropriately provided selection devices which face the needle holder, at the selectors, and can be actuated so as to interfere with the selectors so as to vary their position from active to inactive or vice versa.

Although it is thus possible to use two positions, respectively an active position and an inactive position, for the selectors, it is nonetheless necessary, particularly in double-cylinder machines, to use numerous cams which can move toward or away from the needle holder, in order to diversify the paths that must be followed by the heels of the selectors, of the other elements that actuate the needles and of the needles themselves, in order to meet various knitting requirements.

The presence of these movable cams, which is necessary in order to perform the various types of knitting, entails the problem of considerably complicating the structure of the entire machine.

Moreover, the presence of these movable cams forces the provision, on board the machine, of appropriate sensing elements and appropriate control programs in order to prevent, in case of abnormal operation, the cams from being in a position which is not compatible with the position of the heels of is the selectors or sliders or sub-needles or of the needles themselves, which may lead to damage to said heels, forcing to stop the machine in order to replace them.

SUMMARY OF THE INVENTION

The aim of the present invention is to solve the above-cited problems, by providing a needle control device for stocking knitting machines which allows to considerably simplify the set of cams used to actuate the needles.

Within the scope of this aim, an object of the present invention is to provide a device which allows to eliminate or substantially reduce the number of movable cams required to actuate the needles in performing the various types of knitting of the machine.

Another object of the present invention is to provide a device which, while simplifying the cams required for needle actuation, nonetheless allows to perform the conventional types of knitting allowed in stocking knitting machines.

This aim, these objects and others which will become better apparent hereinafter are achieved by a needle control device for stocking knitting machines, characterized in that it comprises a connecting element which can engage a needle or sub-needle or slider and can be arranged in the same slot of the needle holder that accommodates a needle, and an actuation element which is connected to said connecting element and can oscillate on command on a plane which is substantially parallel to the sides of said slot of the needle holder, said actuation element being provided with at least one first heel and at least one second heel which are mutually spaced along the side of said actuation element that lies opposite the side to be directed toward the bottom of said slot of the needle holder, said actuation element being movable, as a consequence of its oscillation on said plane, into three positions, respectively a first position, in which said heels are both inserted in the corresponding slot of the needle holder, a second position, in which said first heel protrudes from said slot of the needle holder while said second heel is inserted in said slot of the needle holder, and a third position, in which said first heel is inserted in said slot of the needle holder while said second heel protrudes from said slot of the needle holder.

BRIEF DESCRIPTION OF THE DRAWINGS

Further characteristics and advantages of the present invention will become better apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
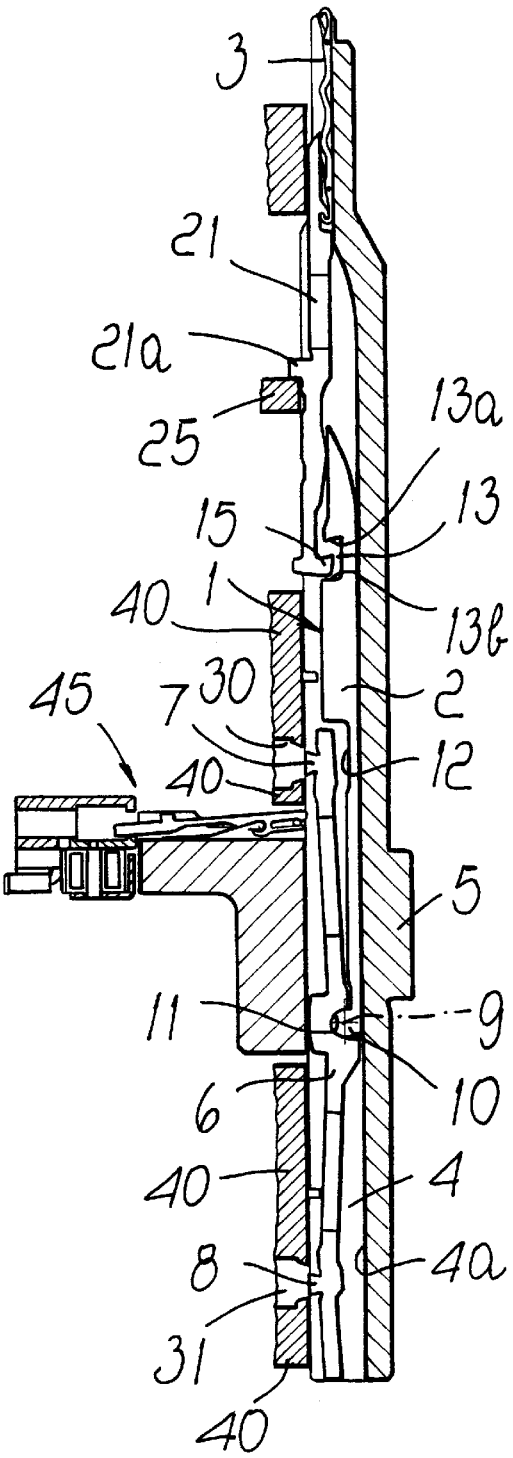
FIGS. 1 to 3 are schematic views of the device according to the invention, applied to the lower cylinder of a double-cylinder circular stocking knitting machine with the actuation element in the three positions that it can assume.

With reference to the accompanying figures, the device according to the invention, generally designated by the reference numeral 1, comprises a connecting element 2, which can directly or indirectly engage a needle 3, 20 and can be arranged in a same slot 4 of a needle holder 5 that accommodates the needle 3, 20, and an actuation element 6, which is connected to the connecting element 2 and can oscillate on command on a plane which is substantially parallel to the sides of the slot 4.

The needle holder 5 can have a substantially flat shape, in the case of rectilinear machines, or a cylindrical shape, in the case of circular machines.

Figure 2:
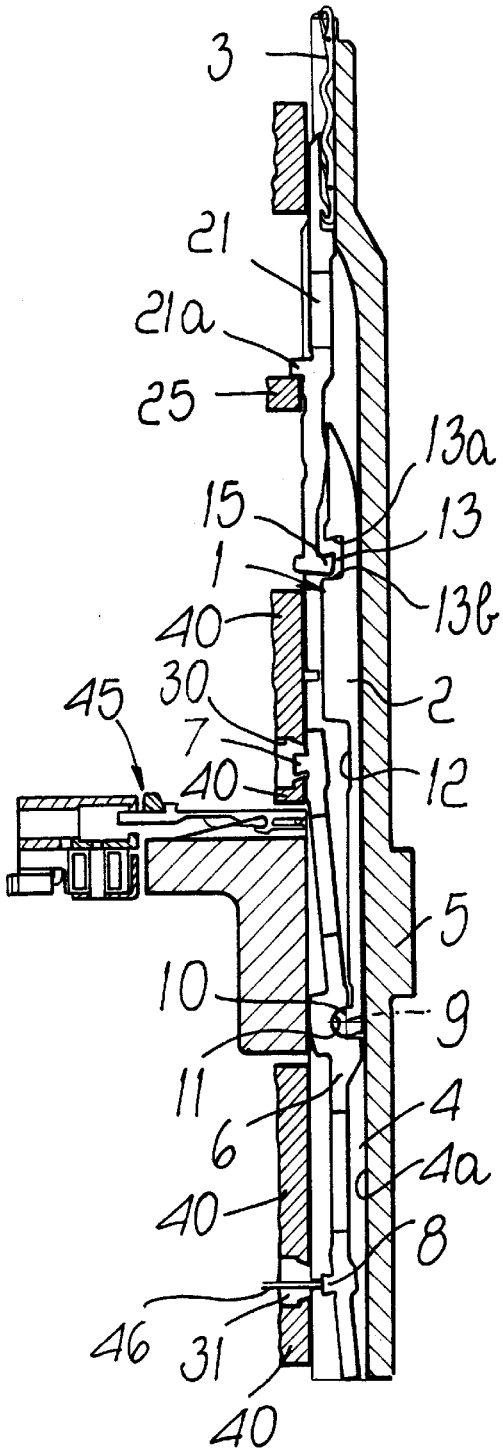
Figure 3:
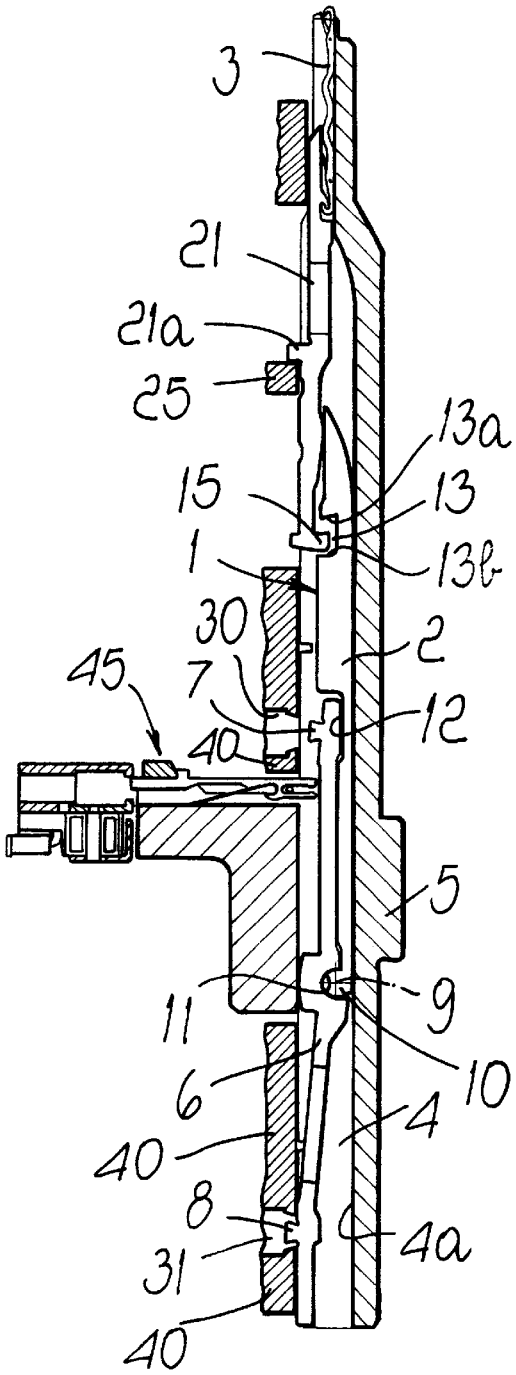

The actuation element 6 is provided with at least one first heel 7 and with at least one second heel 8, which are mutually spaced along the side of the actuation element 6 that is meant to be directed toward the bottom 4*a* of the slot 4. The actuation element 6 can move, as a consequence of its oscillation on the plane that lies parallel to the sides of the corresponding slot 4, in three positions, respectively: a first position, in which the heels 7 and 8 are both inserted in the corresponding slot 4 of the needle holder, as shown in FIG. 1; a second position, in which the first heel 7 protrudes from the slot 4 of the needle holder 5 while the second heel 8 is inserted in the slot 4 of the needle holder 5, as shown in FIG. 2; and a third position, in which the first heel 7 is inserted in the slot 4 while the second heel protrudes from the slot 4 of the needle holder 5, as shown in FIG. 3.

More particularly, the connecting element 2 and the actuation element 6 have a laminar body so that they can be easily slidingly accommodated inside the slot 4 of the needle holder 5.

The actuation element 6 is hinged, with an intermediate portion, to the connecting element 2 about a pivoting axis 9 which is perpendicular to the sides of the connecting element 2 that are meant to face the sides of the slot 4 of the needle holder 5. The first heel 7 and the second heel 8 are located in two mutually opposite regions with respect to the pivoting axis 9, so that the oscillation of the actuation element 6 about the pivoting axis 9, with respect to the connecting element 2, places the actuation element 6 in two stroke limiting positions, in which one of the two heels 7 or 8 protrudes from the slot 4 of the needle holder 5, passing through an intermediate position in which both heels 7 and 8 are inserted in the slot 4 of the needle holder 5.

The pivoting between the actuation element 6 and the connecting element 2 can be provided by giving a pivot-like shape to a portion 10 of the connecting element 2 and by providing, in an intermediate region of the actuation element 6, on the side of the actuation element 6 that is directed toward the bottom 4*a* of the slot 4, a seat 11 which is shaped complementarily.

Preferably, the pivot-shaped portion 10 of the connecting element 2 is arranged at the end of the connecting element 2 that lies opposite the end of the connecting element 2 that is designed to be directed toward the needle 3, 20.

Conveniently, a portion of the connecting element 2, starting from the portion 11, is shaped so as to form a seat 12 which can accommodate the portion of the actuation element 6 that extends from the seat 11 and protrudes toward the needle 3, 20.

The connecting element 2 has, proximate to its end that is meant to be directed toward the needle 3, 20, means for bilateral engagement, along a direction which is parallel to the longitudinal extension of the slot 4 of the needle holder 5 in which it is meant to be accommodated, with the needle 3, 20 or with another element which is designed to engage the needle 3, 20, as will become apparent hereinafter.

The bilateral engagement means comprise a recess 13 which is formed on the side of the connecting element 2 that lies opposite its side meant to be directed toward the bottom 4*a* of the slot 4 of the needle holder 5. Said recess 13 can engage an auxiliary heel 15 of the needle or of another element which is designed to engage the needle.

The recess 13 is delimited, in a direction which is parallel to the side of the connecting element 2 on which it is formed, by two mutually opposite shoulders 13*a* and 13*b* which are substantially perpendicular to the side of the connecting element 2 on which said recess 13 is formed.

Preferably, the shoulder 13*a,* i.e., the shoulder that lies closest to the end of the connecting element 2 that is directed toward the needle, is inclined so as to form an undercut and can engage one side of an auxiliary heel 15 of the needle or of another element which is connected to the needle and is shaped correspondingly.

Figure 4:
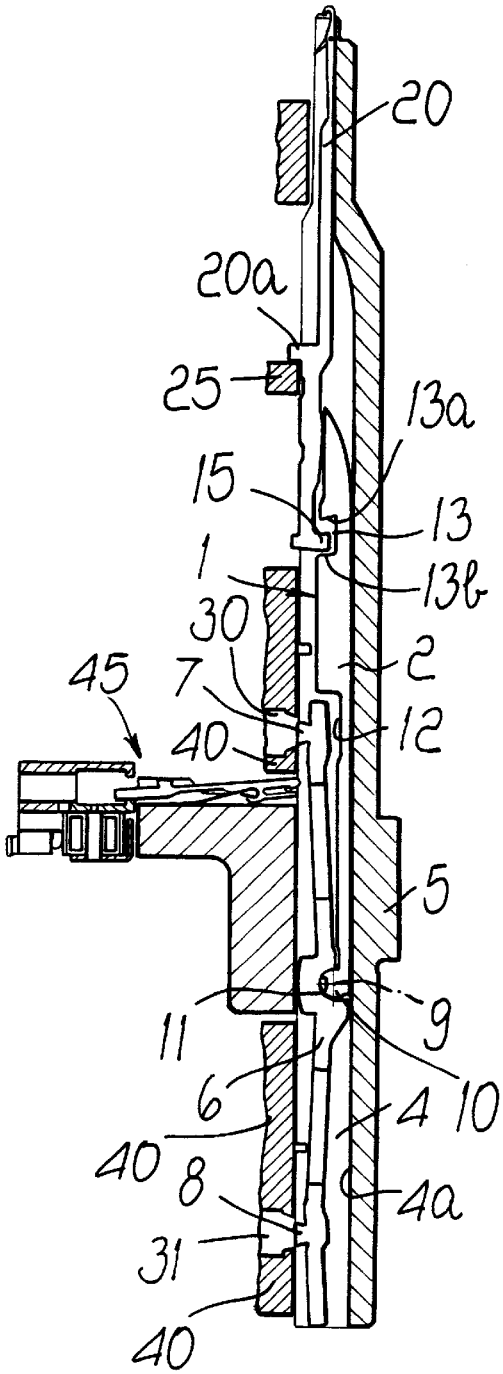
FIG. 4 is a view of the device according to the invention, applied to the needle cylinder of a single-cylinder circular stocking knitting machine with the actuation element in one of its possible operating positions.

The connecting element 2 can engage, depending on the machine on which the device is to be fitted, an auxiliary heel 15 of a needle 20, as shown in particular in FIG. 4, or of a sub-needle, or of a slider 21, as shown in FIGS. 1 to 3.

The auxiliary heel 15 protrudes from the side of the needle or sub-needle or slider that is directed toward the bottom 4*a* of the slot 4 of the needle holder 5.

The slider 21 or the needle 20 that engage the connecting element 2 can be provided, in a per se known manner, with at least one heel 21*a,* 20*a* which protrudes from the side of the slider 21 or of the needle 20 or sub-needle that lies opposite the bottom 4*a* of the slot 4 of the needle holder and is meant to engage within adapted paths traced by cams 35 which face the needle holder 5.

The heels 7 and 8 of the actuation element 6 too can engage, depending on the position of the actuation element 6, within paths 30 and 31 formed by cams 40 which face the needle holder 5.

The oscillation of the actuation element 6 about the pivoting axis 9 can be achieved by means of selection devices, for example the device according to Patent Application No. MI99A000932 in the name of this same Applicant, and/or by means of fixed or movable pressers which are arranged in specific regions of the assembly of the cams 40 and can be engaged by the heels 7 and 8 or by other regions of the actuation element 6.

Merely by way of non-limitative example, the illustrated embodiments have a selection device 45 of the type disclosed in Patent Application No. MI99A000932, which laterally faces the needle holder 5 at the level of the portion of the actuation element 6 that lies between the pivoting axis 9 and the first heel 7 and a presser 46 which faces the needle holder 5 at the level of the second heel 8.

The selection device 45, if activated, interacts with the actuation element 6, making it oscillate so as to arrange the first heel 7 inside the slot 4 and extract from the slot 4 the second heel 8, which can engage the path 31 (FIG. 3).

The presser 46 instead acts on the second heel 8, causing the oscillation of the actuation element 6 in the opposite direction, so that the second heel 8 is inserted in the slot 4 while the first heel 7 is extracted and can engage the path 30 (FIG. 2).

The oscillation of the actuation element 6 so as to place both heels 7 and 8 inside the slot 4 (FIG. 1) can be achieved, for example, by means of pressers which are similar to the presser 46 but shorter and by optionally providing two pressers which face two portions of the actuation element 6 located on mutually opposite sides with respect to the pivoting axis 9.

Substantially, by means of these three possible positions of the actuation element 6 the heels 7 and/or 8 can be made to follow mutually different paths without the need to have movable cams for changing the paths. In this manner, by means of the device according to the invention it is possible to eliminate or substantially reduce the number of movable cams required for the operation of the machine.

In practice it has been observed that the device according to the invention fully achieves the intended aim and objects, since it allows to eliminate or substantially reduce the number of movable cams for the actuation of the needles, thus simplifying the assembly of the needle actuation cams and of the corresponding devices for the actuation and control of said cams.

The device thus conceived is susceptible of numerous modifications and variations, all of which are within the scope of the inventive concept; thus, for example, the oscillation of the actuation element in order to transfer it into the three provided positions can be produced by means of elements which are different from the ones described. All the details may furthermore be replaced with other technically equivalent elements.

In practice, the materials used, as well as the dimensions, may be any according to requirements and to the state of the art.

The disclosures in Italian patent application No. MI99A001145, from which this application claims priority, are incorporated herein by reference.

What is claimed is:

1. A needle control device for stocking knitting machines, comprising:

a connecting element accommodatable in a slot of a needle holder for engaging a needle or sub-needle or slider arranged in said slot of the needle holder; and an actuation element which is connected to said connecting element and which is oscillatable on command on a plane which is substantially parallel to sides of said slot of the needle holder when said connecting element and said actuation element are accommodated in said slot of the needle holder, said actuation element being provided with at least one first heel and at least one second heel which are mutually spaced along a first side of said actuation element that lies opposite a second side of said actuation element directed toward a bottom of said slot of the needle holder when said connecting element and said actuation element are accommodated in said slot of the needle holder, said actuation element being movable when said connecting element and said actuation element are accommodated in said slot of the needle holder, as a consequence of its oscillation on said plane, into three positions, respectively a first position, in which said heels are both inserted in said slot of the needle holder, a second position, in which said first heel protrudes from said slot of the needle holder while said second heel is inserted in said slot of the needle holder, and a third position, in which said first heel is inserted in said slot of the needle holder while said second heel protrudes from said slot of the needle holder.

2. The device according to claim 1, wherein said actuation element is pivoted, with an intermediate portion, to said connecting element about a pivoting axis which is perpendicular to sides of said connecting element that face the sides of said slot of the needle holder when said connecting element and said actuation element are accommodated in said slot of the needle holder, said first heel and said second heel being arranged in two regions which are mutually opposite with respect to said pivoting axis.

3. The device according to claim 1, wherein said actuation element is pivoted at a first end of said connecting element that lies opposite a second end of said connecting element directed toward the needle or sub-needle or slider when said connecting element and said actuation element are accommodated in said slot of the needle holder.

4. The device according to claim 3, wherein said connecting element has, proximate to said second end, means for bilateral engagement, in a direction which is parallel to a longitudinal extension of the slot of the needle holder when said connecting element and said actuation element are accommodated in said slot of the needle holder, with the needle or sub-needle or slider.

5. The device according to claim 4, wherein said bilateral engagement means comprise a recess which is formed in the first side of said connecting element that lies opposite the second side of said actuation element directed toward the bottom of said slot of the needle holder when said connecting element and said actuation element are accommodated in said slot of the needle holder, said recess being engageable with an auxiliary heel of the needle or sub-needle or slider arranged in said slot which is directed toward the bottom of said slot of the needle holder.

6. The device according to claim 5, wherein said recess is delimited, in a direction which is parallel to the first side of said connecting element in which said recess is formed, by two mutually opposite shoulders which are substantially perpendicular to the first side of said connecting element in which said recess is formed.

7. The device according to claim 6, wherein one shoulder of said two shoulders that lies closest to the second end of said connecting element is inclined so as to form an undercut for engaging a side of the auxiliary heel of the needle or sub-needle or slider which is shaped correspondingly.

8. The device according to claim 1, wherein said actuation element is partially accommodatable in a seat which is formed in a first side of said connecting element that lies opposite a second side of said connecting directed toward the bottom of said slot of the needle holder when said connecting element and said actuation element are accommodated in said slot of the needle holder.

* * * * *